United States Patent [19]

Van Til et al.

[11] 4,322,254

[45] Mar. 30, 1982

[54] REGENERATION OF ELECTRICAL CONDUCTIVITY OF METALLIC SURFACES

[75] Inventors: Alan E. Van Til, Itasca; James P. Shoffner, Elk Grove Village, both of Ill.

[73] Assignee: UOP Inc., Des Plaines, Ill.

[21] Appl. No.: 189,448

[22] Filed: Sep. 22, 1980

[51] Int. Cl.[3] ..... C23F 7/00; C23F 7/04

[52] U.S. Cl. ..... 148/6.14 R; 148/6.35; 427/126.1; 427/126.6; 55/5

[58] Field of Search ..... 148/6.35, 6, 14 R; 427/126.6, 397.8, 126.1; 55/2, 5, 10, 12, 13, 101, 115, 116, 118, 120, 134; 209/128, 129

[56] References Cited

U.S. PATENT DOCUMENTS

| | | | |
|---|---|---|---|
| 1,522,143 | 1/1925 | Rathbun | 55/10 |
| 2,728,696 | 12/1955 | Singer | 148/6.35 |
| 4,170,493 | 10/1979 | Schafer | 148/6.35 |

FOREIGN PATENT DOCUMENTS

| | | | |
|---|---|---|---|
| 589023 | 1/1978 | U.S.S.R. | 55/5 |

*Primary Examiner*—Ralph S. Kendall

*Attorney, Agent, or Firm*—James R. Hoatson, Jr.; Raymond H. Nelson; William H. Page, II

[57] ABSTRACT

The electrical conductivity of metallic surfaces may be regenerated in situ by treating the surface with a regenerating agent in the form of a hydrogen halide such as hydrogen chloride. Hydrogen halide may be utilized in either liquid, gaseous or vaporous form. If so desired, an ammonium salt such as ammonium chloride may also be used to enhance the regenerative powers of the hydrogen halide. For example, the surface of steel may be treated with hydrogen chloride and ammonium chloride to enhance the formation of ferric oxide which possesses a greater electrical conductivity than does ferrous oxide.

8 Claims, No Drawings

REGENERATION OF ELECTRICAL CONDUCTIVITY OF METALLIC SURFACES

BACKGROUND OF THE INVENTION

The electrical conductivity of metallic surfaces plays an important role in many processes. In many instances the electrical conductivity is controlled by the type of surface on a metal. For example, steel which consists mainly of iron will have various forms of iron oxide on the surface thereof due to corrosion or scaling of the metal. The various forms of oxides which are present on the surface of the steel will include ferrous oxide (FeO), ferric oxide ($Fe_2O_3$), and magnetite ($Fe_3O_4$), which is also known as ferriferrous oxide. The amount or percentage of the ferrous oxide layer formed on the surface of steel will be dependent upon many variables including the oxygen content of the atmosphere to which the steel is exposed as well as the catalytic effect of the various other metals present in the steel including copper, chromium, nickel, etc. The electrical resistance or conductivity of the various iron oxides will vary, ferrous oxide possessing the least conductivity. In many instances this is a detriment inasmuch as a relatively high electrical conductivity is desired. A particular instance in which a relatively high electrical conductivity is desired comprises electrostatic precipitators which are utilized to remove fly ash from the atmosphere in power plants which burn coal to provide a source of electricity. The electrostatic precipitators which are employed in these plants are fabricated from steel and will contain wires possessing an electrical charge inside the apparatus. The gas stream resulting from the pyrolysis of coal will pass through the precipitator and any fly ash particles which are present in the gas stream will be collected on the plates of the unit. It is therefore necessary that the plates of the unit possess an electrical conductivity sufficient that an electrical charge can be built up upon the oxide surface to attract the particles to the metal surface and yet be not so great so as to prevent the particles after agglomeration from being removed from the inner surface of the unit.

A problem which arises is that an iron oxide layer in the form of ferrous oxide which is highly electrically resistive will form on the surface of the unit. While this layer can be made to have an electric charge which is positive with respect to the wire passing through the unit and the fly ash particles in the gas stream even when highly electrically resistive, the rate of charge transfer is very low and correspondingly the rate of fly ash deposition is very low. It is necessary that the electrical conductivity be increased sufficiently that the charge transfer increases to effectively remove the fly ash particles from the gas stream before the gas stream is passed to the atmosphere. In order to improve the electrical conductivity of fly ash-plate system, the presently available methods concentrate on the fly ash. There are three methods currently being employed to increase the electrical conductivity of the fly ash particles. Two methods which are currently employed comprise a method known as doping the coal with sodium compounds such as sodium sulfate, sodium carbonate, etc., or by injecting ammonia gas into the flue gas in order to form ammonium salts in situ to increase the electrical conductivity of the fly ash particles. The third method which is currently employed comprises spraying sulfuric acid into the flue gas to increase electrical conductivity of the particles. However, a serious drawback which is attendant to the use of sulfuric acid lies in the fact that noxious compounds of sulfur or sulfate are formed which must be removed from the gas which is discharged into the atmosphere. This removal will of necessity entail the use of additional equipment in order to scrub the undesired compounds from the flue gas.

As will hereinafter be shown in greater detail, it has now been discovered that metal surfaces can be regenerated to permit the presence of desirable oxides on the surface thereof, said oxides possessing the required electrical conductivity for use in many processes. These methods then improve the electrical conductivity of the plates used in electrostatic precipitator making the continuous conditioning treatments of the coal described above unnecessary.

DESCRIPTION OF THE INVENTION

This invention relates to a method for the regeneration of electrical conductivity of metallic surfaces. More specifically, the invention is concerned with a method for removal of undesired metallic oxides from the surface of metals with the attendant formation of more desirable forms of the oxides thereon.

As hereinbefore set forth, the operation of power plants to provide electrical energy involves, in many instances, the use of fuels such as coal to generate the electricity. Inasmuch as coals contain various amounts of undesirable compounds such as sulfur, as well as products of combustion such as fly ash, it is necessary that these undesirable contaminants be removed before venting the flue gas to the atmosphere. In recent years this has become a serious problem due to various governmental regulations which have arisen controlling the amount of contaminants which may be discharged along with the flue gas. The present invention is concerned with the removal of one of these contaminants, namely, fly ash particles from the flue gas. The fly ash particles are currently removed by using an electrostatic precipitator which is fabricated from metals and usually from steel. The removal of the fly ash particles is effected by passing the flue gas containing said particles through the precipitator which may be a series of plates set in a parallel configuration and which contains a set of wires between the plates running through the length of the precipitator. The fly ash particles are removed from the flue gas by passing an electric charge through the wires. The particles will then pick up this charge and due to a difference in electric charge will be drawn to the surfaces of the plates. The fly ash will collect on the surface of the plates and after a sufficient amount has agglomerated the plates are rapped so that the fly ash will drop to the bottom of the precipitator and be removed therefrom. However, it is necessary in order to effect this removal of the particulates that there be a sufficient reduction in their electric charge as a result of transfer between the plates of the precipitator and the fly ash particles. The plates must have a higher relative electrical conductivity than the fly ash to produce the proper charge transfer rate. During the operation of the precipitator, ferrous oxide, which possesses a relatively lower electrical conductivity will be formed on the surface of the precipitator plates and it is therefore necessary to remove or alter this oxide in order to permit the precipitator to operate with better efficiency.

It is therefore an object of this invention to provide a method for regenerating the electrical conductivity of metallic surfaces.

In one aspect an embodiment of this invention resides in a method for the regeneration of electrical conductivity of metallic surfaces, the reactive oxides of the metal being electrically insulative in character, which comprises treating said surfaces with a hydrogen halide at treating conditions to form oxides of varying valences, the sum of said oxides formed possessing greater electrical conductivity.

A specific embodiment of this invention is found in a method for the regeneration of electrical conductivity of steel which comprises treating the surface of said steel with hydrogen chloride and ammonium chloride at a temperature in the range of from about ambient to about 900° F. and a pressure in the range of from about 5 to about 5000 psi to form oxides of varying valences such as ferrous oxide and ferric oxide, the sum of said oxides formed possessing greater electrical conductivity than that of a single oxide form.

Other objects and embodiments will be found in the following further detailed description of the present invention.

As hereinbefore set forth, the present invention is concerned with a method for regenerating the electrical conductivity of metallic surfaces. The regeneration is necessary in order to maintain a desirable difference in conductivity between the metallic surfaces and fly ash particulates present in flue gas. The regeneration of the electrical conductivity is effected by treating the metallic surfaces which possess oxides thereon in order to obtain oxides of varying valences. This is a desirable feature inasmuch as the sum of the various oxides which are formed during the process will possess greater electrical conductivity than is possessed by a metallic oxide possessing only a single valence. The metal surfaces are treated by contacting the surfaces with a hydrogen halide at treating conditions. These treating conditions which are employed will include a temperature which may be in the range of from about ambient (68°-77° F.) up to about 900° F. Another operating parameter of the present method will include nozzle pressures which may be in a range of from about 5 to about 5000 pounds per square inch (psi). Hydrogen halides which are employed to effect the treatment of the present method will include hydrogen chloride, hydrogen fluoride, hydrogen bromide and hydrogen iodide. By treating the surface of a metallic plate with the hydrogen halide, it is possible to alter the oxide which is formed on the surface of said plate by, in effect, oxidizing the metal oxide to a higher valence state. Thus, in the case of iron, it is possible to treat a steel plate which possesses a relatively uniform coating of ferrous oxide on the surface thereof to form a mixture of ferric oxide, ferriferrous oxide and ferrous oxide, the mixture of these various forms of oxides possessing an electrical conductivity which is far greater than that which is possessed by ferrous oxide alone.

It is also contemplated within the scope of this invention that the regeneration of the electricai conductivity of metallic surfaces can be improved by incorporating an ammonium salt with the hydrogen halide treatment of the surface. The utilization of ammonium salts such as ammonium chloride, ammonium bromide, ammonium fluoride, ammonium iodide, etc., may be effected in conjunction with the hydrogen halide by a simultaneous treatment of the metal surface. In the preferred embodiment of the invention, aqueous solutions containing from about 0.5 to about 25% or more of the ammonium salt may be combined with from about 5 to about 15% of the hydrogen halide to produce the desired results. Using steel as an example, an aqueous solution of ammonium chloride applied to the surface thereof will preferentially produce ferric chloride over ferric oxide. However, this solution is not as effective in removing the undesired ferrous oxide as does a hydrogen halide such as hydrogen chloride. However, by combining a hydrogen halide such as hydrogen chloride with ammonium chloride, it is possible to readily attack the ferrous oxide which is found under the surface of the ferric oxide and thus oxidize it to ferric oxide due to the action of the hydrogen chloride. Additionally the ammonium chloride will convert a fractional amount of the ferric oxide to ferric chloride which possesses a much greater electrical conductivity and, therefore, the combined compounds will act to produce a metallic surface which possesses the desired electrical conductivity.

The application of the hydrogen halide and, if so desired, the ammonium salt may be accomplished by a wide variety of methods. In one instance, the regenerating agents may be in aqueous form and thus be sprayed on, poured on, or squeegeed on in a sufficient quantity to cover the plate or metallic surface which is to be treated while, at the same time, minimizing the drip off of the liquid with a minimization of corrosion of other elements of the plate assembly. In another embodiment, the regenerating agents may be applied to the metallic surface in the gas phase by means of injection of the gaseous forms of ammonia and the hydrogen halide onto the surfaces of the plates to be treated. By utilizing the injection method in gaseous form, it is possible to localize the treatment and therefore effect a selective regeneration of different actions and/or individual plates. By utilizing this method, it is possible to effect the regeneration without using excessive amounts of the regenerating agents, thus obviating needless corrosion of other elements of the apparatus. A third method of effecting the regeneration of metallic surfaces is by applying the regenerating agents comprising the hydrogen halide and, if so desired, ammonium salts as a vapor or mist. This is effective by passing aqueous solutions of the reactants onto the surfaces of the metal plates under a sufficient amount of pressure to create the desired vaporous stream.

It is also contemplated within the scope of this invention that a fourth method of surface regeneration may be employed. This method entails the addition of an additive package to the coal prior to combustion in the boiler such that the halide content of the flue gas is increased to a level which is effective for the desired transformation of the oxide. The method is effected by incorporating from about 0.1 to about 0.4 percent by weight of an alkali metal or alkaline earth metal halide such as sodium chloride, potassium chloride, sodium bromide, potassium iodide, magnesium chloride, magnesium iodide, calcium fluoride, etc. or an ammonium halide such as ammonium chloride onto the coal which is used for the coal fuel power plant.

While the above set forth discussion has been concerned primarily with the regeneration of electrical conductivity on the surface of steel, it is also contemplated within the scope of this invention that other conductive metals may be treated in a similar manner utilizing the regenerating agents hereinbefore set forth in order to increase the electrical conductivity of said metals. Some specific examples of metals which may be treated to improve the electrical conductivity by creating oxides of varying valences will include nickel to provide nickel oxide (NiO), nickel sesquioxide ($Ni_2O_3$), etc. titanium to provide titanium dioxide ($TiO_2$), titanium sesquioxide ($Ti_2O_3$), titanium peroxide ($TiO_3$); vanadium to provide vanadium dioxide ($V_2O_2$), vanadium trioxide ($V_2O_3$), vanadium tetraoxide ($V_2O_4$), and vanadium pentaoxide ($V_2O_5$), etc., although not necessarily with equivalent results.

The following examples are given for purposes of illustrating the process of this invention. However, it is to be understood that these examples are merely for purposes of illustration and that the present invention is not necessarily limited thereto.

EXAMPLE I

A one foot square steel plate which was 0.046" in thickness and which had been water washed was cut into coupons approximately 2" square. One side of the plate was sandblasted prior to cutting into coupons to remove an outer layer of hydroxylated iron oxide (FeOOH) and ferric oxide ($Fe_2O_3$) to assure a uniformity of pretreatment. Thereafter, the coupons were further cut to a size of about $\frac{1}{4}'' \times \frac{5}{8}''$ and the coupons were notched on the edges thereof for coding. Thereafter the coupons, except the ones utilized as blanks, were dipped into a regenerating solution momentarily, removed, and redipped two more times. This procedure was followed in order to simulate the contact time which would be utilized by spraying the regenerating agent on a steel plate at low pressures. The test solution varied from a hydrogen chloride to water concentration ranging from 1:25 to 1:2 volume/volume. In a second test, solutions were prepared and used in which ammonium chloride in a weight/volume ratio of from 1:200 to 1:10 was added to either a test solution containing a concentration of hydrogen chloride to water of 1:2 volume/volume or of 1:4 volume/volume on the same size coupons.

In a third test, larger coupons of $1\frac{1}{8}''$ square were cut and notched. They were dipped, dried and heat treated as described below. After these treatments, one side was sandblasted clean to bare metal and Pt metal contacts were sputter coated on the metal.

The test coupons were then air dried for a period of 24 hours and placed in a quartz walled tube furnace. The furnace was heated to a temperature of 770° F. in an air/nitrogen atmosphere. Upon reaching the operating temperature, water vapor was cut in and maintained for a total heating time of 4 hours. At the end of the 4 hour period, the water vapor was cut out and the coupons were slowly cooled in an air/nitrogen atmosphere until they reached room temperature.

The coupons were then removed from the tube furnace and examined by photoacoustic spectroscopy (P.A.S.) from 200 to 1600 nanometers using a lamp modulation frequency of 40 hertz. The spectra which was obtained from this examination disclosed that the maximum conversion of ferrous oxide to ferric oxide occurs when the acid/water ratio of 1:2 and an ammonium chloride/water ratio of 1:10 comprised the regenerating agent.

In addition to the P.A.S. examination, the electrical conductivity of the coupons was also examined. This was accomplished by placing the sample coupons between Pt metal electrodes and measuring their electrical conductivity with an impedance bridge in a DC mode using an applied voltage of 20 VDC at room temperature.

The results of this first test are set forth in Table I below:

TABLE I

| Regenerating Agent | Averaged Absorption at 500nm | Conductivity ($ohm^{-1}$) |
|---|---|---|
| Blank | 0.074 | $1.1 \times 10^{-4}$ |
| 1:25 $HCl/H_2O$ v/v | 0.084 | $3.0 \times 10^{-4}$ |
| 1:4 $HCl/H_2O$ v/v | 0.116 | $5.9 \times 10^{-4}$ |
| 1:2 $HCl/H_2O$ v/v | 0.555 | $4.7 \times 10^{-3}$ |

The results of the third test are set forth in Table II below:

TABLE II

| Regenerating Agent | Conductivity ($ohm^{-1} - cm^{-1}$) |
|---|---|
| Blank | $3.1 \times 10^{-11}$ |
| 1:2 $HCl/H_2O$ v/v; 1:10 $NH_4Cl/H_2O$ wt/v | $4.48 \times 10^{-6}$ |
| 1:2 $HCl/H_2O$ v/v; 1:50 $NH_4Cl/H_2O$ wt/v | $8.42 \times 10^{-8}$ |
| 1:2 $HCl/H_2O$ v/v; 1:200 $NH_4Cl/H_2O$ wt/v | $7.31 \times 10^{-10}$ |
| 1:4 $HCl/H_2O$ v/v; 1:10 $NH_4Cl/H_2O$ wt/v | $4.29 \times 10^{-8}$ |
| 1:4 $HCl/H_2O$ v/v; 1:50 $NH_4Cl/H_2O$ wt/v | $3.96 \times 10^{-10}$ |
| 1:4 $HCl/H_2O$ v/v; 1:200 $NH_4Cl/H_2O$ wt/v | $2.35 \times 10^{-10}$ |

EXAMPLE II

Other metallic surfaces such as titanium or vanadium may be treated with hydrogen halide regenerating agents such as hydrogen bromide or hydrogen fluoride alone or in combination with an ammonium salt such as ammonium bromide, ammonium fluoride, or ammonium chloride and similar regeneration of electrical conductivity may be obtained.

EXAMPLE III

The electrical conductivity of a steel surface may be regenerated by incorporating about 0.4% by weight of sodium chloride into the coal which is to be used as the fuel source for a power plant. The flue gas may then contain a sufficient concentration of hydrogen chloride formed during the combustion to chemical treat the oxides on the surface of the steel and regenerate the electrical conductivity thereof.

We claim as our invention:

1. A method for the regeneration of electrical conductivity of a metallic iron surface having a coating of ferrous oxide, which comprises simultaneously contacting the ferrous oxide-coated iron surface with a hydrogen halide and an ammonium halide at conditions to form a mixture of ferric oxide and ferric chloride having an electrical conductivity greater than that of ferrous oxide.

2. The method as set forth in claim 1 in which said conditions include a temperature in the range of from about ambient to about 900° F. and a pressure in the range of from about 5 to about 5000 psi.

3. The method as set forth in claim 1 in which said hydrogen halide is hydrogen chloride.

4. The method as set forth in claim 1 in which said hydrogen halide is hydrogen fluoride.

5. The method as set forth in claim 1 in which said hydrogen halide is hydrogen bromide.

6. The method as set forth in claim 1 in which said ammonium halide is ammonium chloride.

7. The method as set forth in claim 1 in which said ammonium halide is ammonium bromide.

8. The method as set forth in claim 1 in which said ammonium halide is ammonium fluoride.

* * * * *